US006571661B1

(12) United States Patent
Hemenway et al.

(10) Patent No.: US 6,571,661 B1
(45) Date of Patent: Jun. 3, 2003

(54) BRAKE PEDAL DESIGN

(75) Inventors: Philip Robert Hemenway, Ann Arbor, MI (US); Junaid Akhtar, Westland, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/062,882

(22) Filed: Jan. 31, 2002

(51) Int. Cl.[7] ..... G05G 1/14; G05G 1/04
(52) U.S. Cl. ..... 74/512; 74/526
(58) Field of Search ..... 74/560, 512, 513, 74/526; 123/399

(56) References Cited

U.S. PATENT DOCUMENTS

| | | | | | |
|---|---|---|---|---|---|
| 2,743,329 | A | | 4/1956 | Vartanian | |
| 3,774,471 | A | | 11/1973 | Pezza | |
| 3,926,275 | A | | 12/1975 | Nersesian | |
| 4,009,623 | A | | 3/1977 | Smith et al. | |
| 4,181,834 | A | * | 1/1980 | Kyonomine | 200/61.89 |
| 4,218,937 | A | | 8/1980 | Albrecht et al. | |
| 4,356,471 | A | | 10/1982 | Nienaber | |
| 4,439,650 | A | | 3/1984 | Brown | |
| 4,454,497 | A | | 6/1984 | Morse | |
| 4,598,457 | A | * | 7/1986 | Kiwak et al. | 29/411 |
| 5,115,162 | A | | 5/1992 | Leonard et al. | |
| 5,507,201 | A | * | 4/1996 | Fairbairn et al. | 74/513 |
| 5,575,181 | A | | 11/1996 | Baumann | |
| 5,868,040 | A | * | 2/1999 | Papenhagen et al. | 74/512 X |
| 5,881,605 | A | | 3/1999 | Doolittle et al. | |
| 5,934,152 | A | * | 8/1999 | Aschoff et al. | 74/513 |
| 6,101,896 | A | | 8/2000 | Engelgau | |
| 6,186,026 | B1 | | 2/2001 | Shaw et al. | |
| 6,253,635 | B1 | | 7/2001 | Huber | |
| 6,295,891 | B1 | * | 10/2001 | Velte et al. | 74/513 |
| 6,330,838 | B1 | * | 12/2001 | Kalsi | 74/514 |
| 2002/0002873 | A1 | * | 1/2002 | Yaddehige | 74/512 |

FOREIGN PATENT DOCUMENTS

| | | | | |
|---|---|---|---|---|
| DE | 19500666 A1 | * | 7/1996 | 74/512 |
| DE | 19851917 A1 | * | 5/2000 | 74/512 |
| DE | 19939810 A1 | * | 2/2001 | 74/512 |

OTHER PUBLICATIONS

CRC Handbook of tables for Applied Engineering Science, second edition, CRC Press, 1976, pp. 149–151.*

* cited by examiner

*Primary Examiner*—Vinh T. Luong
(74) *Attorney, Agent, or Firm*—Brinks Hofer Gilson & Lione

(57) ABSTRACT

A brake pedal system includes a brake pedal having a flexible arm with a first distal end adapted to be mounted to the structure of a vehicle and a second distal end having a foot pad. At least one sensor is mounted to the brake pedal and is adapted to sense the amount of deflection of the brake pedal and send a corresponding signal. A stop is adapted to be mounted within the vehicle at a distance from the brake pedal such that the brake pedal will contact the stop after flexing a pre-determined amount.

5 Claims, 4 Drawing Sheets

BRAKE PEDAL DESIGN

TECHNICAL FIELD

The present invention generally relates to a brake pedal adapted to provide simulated brake feel. Specifically, the present invention is a brake pedal for a brake by wire system wherein the brake pedal is adapted to provide force feedback to an operator to simulate the feel of a conventional brake system.

BACKGROUND OF THE INVENTION

In a conventional vehicle, a brake pedal is connected to a hydraulic braking system, whereby pressure applied to the pedal compresses brake fluid within the braking system to actuate the brakes of the vehicle. In this type of system, as the pedal is depressed, the force necessary to further depress the pedal increases because the pressure of the brake fluid within the system increases. This provides a brake feel to the operator. The operator has a physical sense of how hard the brakes are being applied due to the amount of force that the operator is exerting to the brake pedal.

In brake-by-wire systems, there is no physical connection between the brake pedal and the brakes on the vehicle. The amount of force that the operator exerts is not the controlling factor, rather sensors within or attached to the brake pedal sense movement of the pedal and send a signal to a controller which activates the brakes of the vehicle electronically. These systems typically lack the brake feel provided by traditional systems. Some techniques have been developed to mimic the brake feel of the traditional braking systems such as connection the brake pedal to an electric motor to provide modulated resistance. Unfortunately, many of these types of techniques offer only a flat line resistance which does not truly emulate the increasing resistance of a traditional brake pedal. More complicated systems involve many components which cause packaging and weight concerns for the manufacturer of the vehicle. Therefore, there is a need for a brake pedal adapted to emulate the brake feel provided by traditional brake pedal systems.

DETAILED DESCRIPTION OF THE PREFERRED EMBODIMENTS

The following description of the preferred embodiments of the invention is not intended to limit the scope of the invention to these preferred embodiments, but rather to enable any person skilled in the art to make and use the invention.

Figure 1:
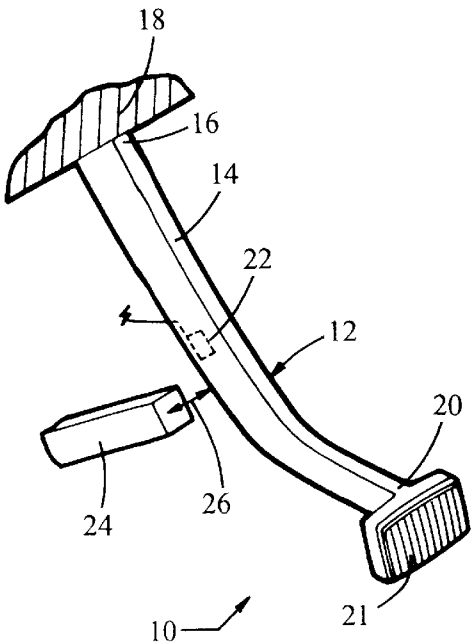
FIG. 1 is a perspective view of a brake pedal and stop of the present invention shown where the brake pedal in not flexed.

Referring to FIG. 1, a brake pedal system of the present invention is generally shown at 10 The brake pedal system 10 includes a brake pedal 12 having a flexible arm 14. A first distal end 16 of the flexible arm is adapted to be mounted to the structure 18 of a vehicle. A second distal end 20 of the flexible arm 14 has a foot pad 21 mounted thereon which is adapted to provide a surface for an operator of the vehicle to actuate the brake pedal 10.

Preferably, the flexible arm 14 of the brake pedal 12 is made from a fiber reinforced composite. In the preferred embodiment, the flexible arm 14 is made from glass fibers within an epoxy matrix.

The brake pedal 12 includes at least one sensor 22 mounted thereon. Preferably, the sensor or sensors 22 are molded within the structure of the flexible arm 14. Having the sensor 22 molded within the flexible arm 14 alleviates the problems of contamination interfering with the performance of the sensor 22 and the possibility of the sensor 22 being damaged. The sensor 22 is adapted to sense the amount of deflection of the flexible arm 14 and to send a corresponding signal to a control unit (not shown) which controls how hard the brakes of the vehicle are applied. Preferably, the more deflection within the brake pedal 12, the harder the brakes of the vehicle will be applied.

Figure 2:
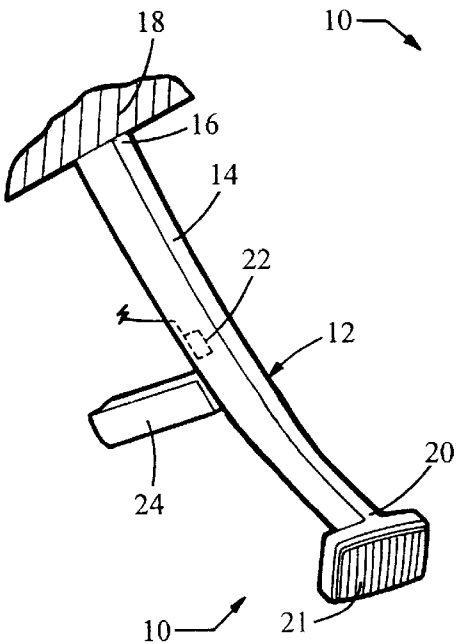
FIG. 2 is a perspective view of the brake pedal and stop of FIG. 1 shown where the brake pedal is flexed to the point of contacting the stop.
Figure 4:
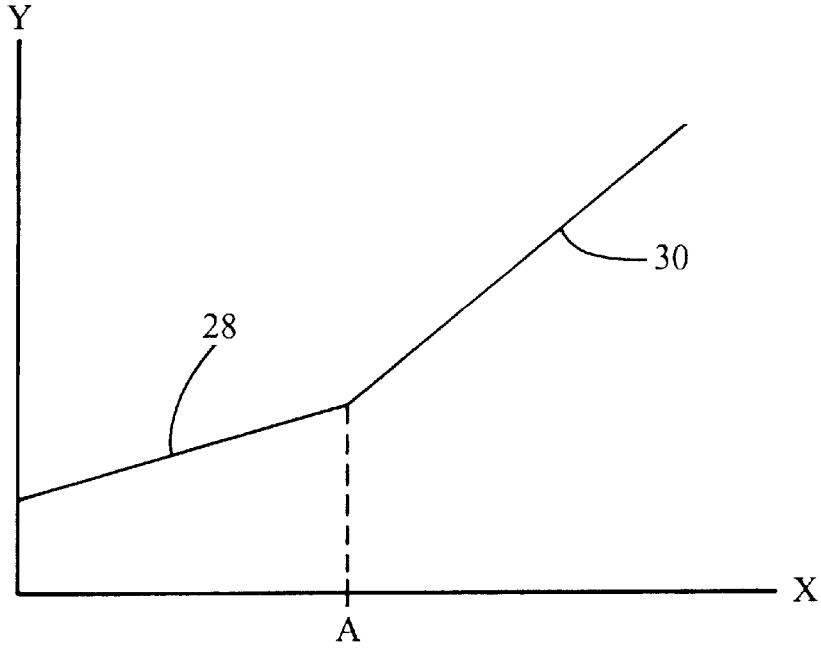
FIG. 4 is a force versus distance graph for a first preferred embodiment of the present invention.

A stop 24 is mounted to the structure of the vehicle at a distance 26 from the brake pedal 12 such that the brake pedal 12 will contact the stop 24 after flexing a pre-determined amount. Referring to FIG. 2, when the brake pedal 12 is actuated the flexible arm 14 comes into contact with the stop after the brake pedal 12 moves through the distance 26. Referring to FIG. 4, a graph is shown which illustrates the relationship between the distance the brake pedal 12 moves and the amount of force necessary to move the brake pedal 12. The x axis represents the amount of deflection of the brake pedal 12 and the y axis represents the amount of force applied to the brake pedal 12.

In a first preferred embodiment of the present invention, the stop 24 is made from a non-compressible rigid material. The force required to bend the flexible arm 14 of the brake pedal 12 is shown as a straight line 28 starting at zero wherein the amount of force increases as the distance that the brake pedal 12 has been flexed increases. The point at which the brake pedal 12 contacts the stop 24 is shown on the graph of FIG. 4 at A. The non-compressible stop 24 will provide a positive stop to prevent the brake pedal 12 from moving any further at the point of contact. At this point, the flexible arm 14 will continue to bend, however, because the flexible arm 14 is supported at the end and at the point of contact with the stop 24, the moment forces necessary to bend the flexible arm 14 are higher. This higher force is represented by the straight line 30 which begins at point A. The forces required to continue bending the brake pedal 12 after contact with the rigid stop 24 are higher, and thus the force versus distance graph becomes steeper.

Figure 3:
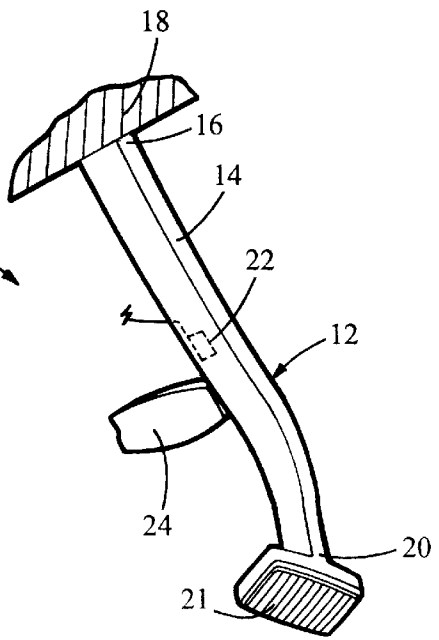
FIG. 3 is a perspective view of the brake pedal and stop of FIG. 1 shown where the brake pedal is flexed to the point of contacting the stop and has compressed the stop.
Figure 5:
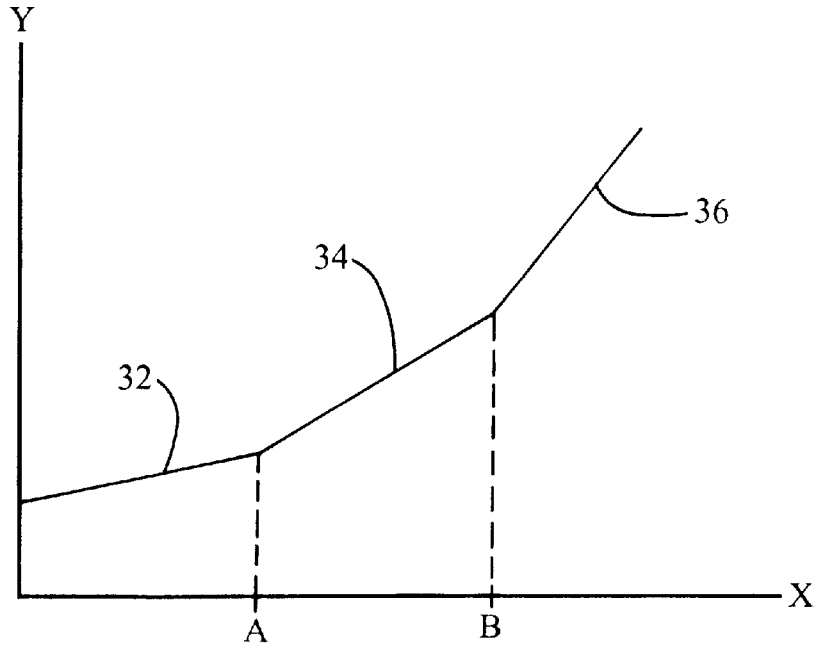
FIG. 5 is a force versus distance graph for a second preferred embodiment of the present invention.

Referring to FIG. 3, in a second preferred embodiment of the present invention, the stop 24 is formed from a compressible material such that the brake pedal 12 will contact the stop 24 after flexing a predetermined amount and the stop 24 will allow additional flexing of the brake pedal 12 after the brake pedal 12 contacts the stop 24. Referring to FIG. 5, a force versus distance graph for the second preferred embodiment is shown. Because the stop 24 is compressible and allows additional flexing of the brake pedal 12, the force versus distance graph for the second preferred embodiment will include three discrete phases. Just as with the first preferred embodiment, the force required to bend the flexible arm 14 of the brake pedal 12 is shown as a straight line 32 starting at zero wherein the amount of force increases as the distance that the brake pedal 12 has been flexed increases. The point at which the brake pedal 12 contacts the stop 24 is shown on the graph of FIG. 5 at A.

Once the brake pedal 12 contacts the stop 24, continued application of force to the brake pedal 12 will cause additional flexing of the brake pedal 12 as well as compression of the stop 24. The additional force necessary to compress the stop 24 increases the overall force necessary to continue flexing the brake pedal 12. A second phase of the graph of FIG. 5 is shown by a straight line 34 extending from point A to point B. The forces required to continue bending the brake pedal 12 and to compress the stop 24 after contact with the stop 24 are higher, and thus the force versus distance graph becomes steeper.

After being compressed a certain amount, the compressible stop will bottom out. In other words, the material will be compressed as much as possible under the forces expected to be exerted by an operator of the vehicle. At this point, the stop is no longer compressible and becomes a substantially rigid stop. The point where the stop bottoms out is shown on the graph of FIG. 5 at point B. Just as with the first preferred embodiment, the brake pedal can still be flexed after the stop bottoms out, however the forces are much higher. The forces required to continue bending the brake pedal 12 and to compress the stop 24 after contact with the stop 24 are higher, and thus the force versus distance graph becomes steeper as us shown by the straight line 36 extending from point B.

Figure 6:
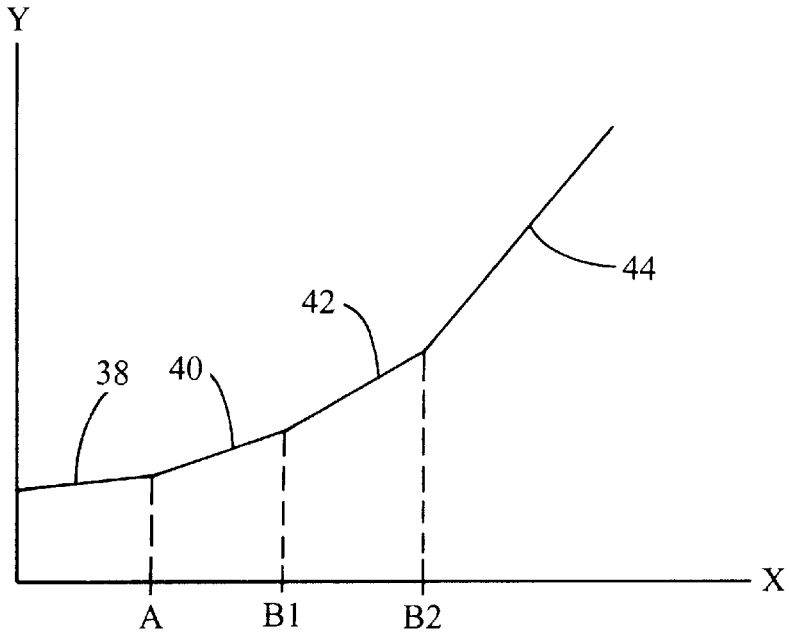
FIG. 6 is a force versus distance graph for a variation of the second preferred embodiment.
Figure 8:
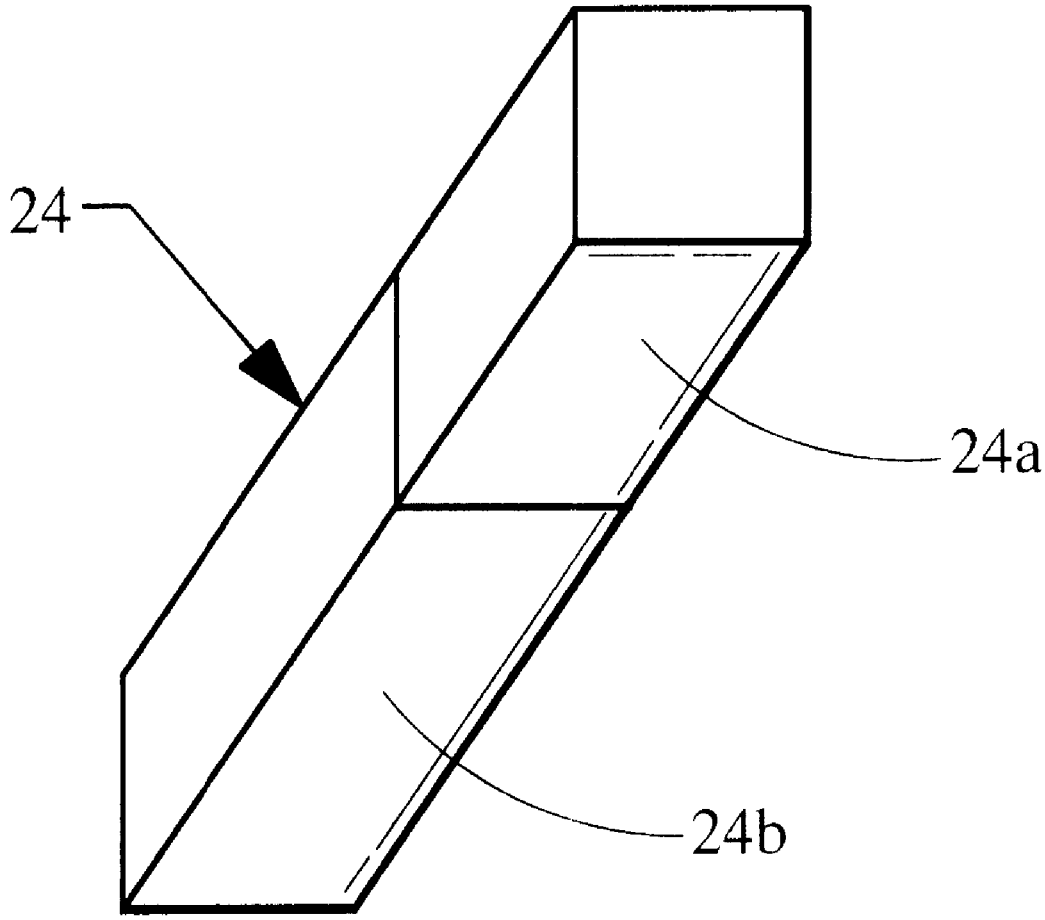
FIG. 8 is a perspective view of a stop having two discrete layers of compressible material.

Alternatively, the compressible stop 24 can included a plurality, of layers of compressible materials with different stiffness, such that the stop 24 will provide variable stiffness resistance to continued flexing of the brake pedal 12 after the brake pedal 12 contacts the stop 24. Referring to FIG. 8, a stop 24 having two discrete layers is shown. The stop 24 includes a first layer 24*a* and a second layer 24*b*, which is more stiff than the first layer 24*a*. Referring to FIG. 6, a force versus distance graph is shown for a brake pedal assembly having the compressible stop shown in FIG. 8. Each successive layer of compressible material within the stop 24 will require an additional amount of force to compress and will bottom out at different times.

Just as with the first preferred embodiment, the force will increase slightly as the brake pedal 12 is flexed up to the point where the brake pedal 12 contacts the stop 24. This is shown by the straight line 38 which extends up to point A which is where the brake pedal 12 contacts the stop 24. Once the brake pedal contacts the stop 24, the first layer 24*a* of compressible material begins to compress, thereby requiring additional force to continue bending the brake pedal 12 This is shown by the straight line 40 extending from point A to point B1.

Eventually, the second layer 24*b* of compressible material will begin to compress. This is shown on the graph at B1. When the second layer 24*b* begins to compress, the first layer 24*a* may or may not be bottomed out. The additional force necessary to compress the second layer 24*b* is shown by the straight line 42 extending from B1 to B2. Just as with the first and second preferred embodiments, the brake pedal can still be flexed after both layers 24*a*, 24*b* of the stop 24 have bottomed out, however the forces are much higher and thus the force versus distance graph becomes steeper as us shown by the straight line 44 extending from point B2.

As described and shown in FIGS. 4–7, the discrete phases of the force versus distance graphs have been shown as straight lines. It is to be understood, however, that the force profile as the brake pedal 12 is flexed could be non linear. For instance, as shown in FIGS. 4, 5 and 6, the force increases linearly, as shown by lines 28, 32 and 38 respectively, as the brake pedal 12 is flexed up to the point of contact with the stop 24, shown by point A in all three figures. It should be apparent to those skilled in the art that the brake pedal 12 and the stop 24 could be made from material where the force increases non-linearly as the brake pedal 12 is flexed.

In a third preferred embodiment of the present invention, the flexible arm 14 of the brake pedal 12 is made from a material with variable stiffness whereby an operator can selectively increase or decrease the stiffness of the brake pedal 12 according to personal preference. Suitable materials are known in the industry as "smart materials". This type of material allows the stiffness of the material to be adjusted by controlling an electric current through the material. This electric current can be selectively controlled to allow the operator of a vehicle to adjust the feel of the brake pedal 12 to personal preference.

Figure 7:
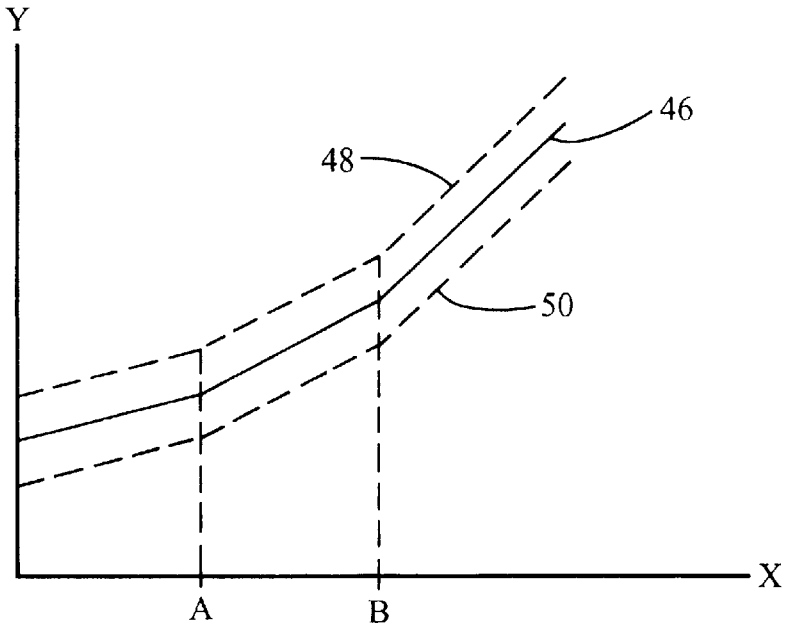
FIG. 7 is a force versus distance graph for a third preferred embodiment of the present invention.

Referring to FIG. 7 a force versus distance graph is shown for a brake pedal assembly 10 having a stop 24 made from a compressible material such as in the second preferred embodiment. However, the stiffness of the material of the flexible arm 14 of the third preferred embodiment can be selectively increased or decreased according to the operator's preference. The force profile 46 would increase up to point A and to point B and beyond just as with the second preferred embodiment, however, the operator would have the option of shifting the feel of the brake pedal 12 to a stiffer parallel force profile 48 or a less stiff parallel force profile 50 according to their personal preference.

The present invention provides a brake pedal for a brake by wire system which will provide a brake feel to the operator that simulates the feel of traditional braking systems. The flexible arm 14 and the stop 24 of the preferred embodiments are adapted to provide various force versus distance profiles for a brake pedal such that more force is required from the operator of the vehicle in order to increase the braking of the vehicle.

The foregoing discussion discloses and describes three preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

We claim:

1. A brake pedal system comprising:

a brake pedal having an arm with a first end adapted to be fixedly mounted to a structure of a vehicle and a second end having a foot pad thereon;

at least one sensor mounted to said brake pedal adapted to sense the amount of deflection of said brake pedal and send a corresponding signal; and a stop adapted to be mounted within the vehicle at a distance from said brake pedal such that said brake pedal will contact said stop after being flexed through said distance, said stop including a plurality of sections having varying levels of stiffness, whereby said stop provides progressively increasing stiffness resistance to continued flexing of said brake pedal after said brake pedal contacts said stop.

2. The brake pedal system of claim 1 wherein said arm comprises a fiber-reinforced composite material.

3. The brake pedal system of claim 2 wherein said arm comprises glass fiber and epoxy.

4. The brake pedal system of claim 1 wherein said at least one sensor is located within said brake pedal.

5. A brake pedal system comprising:

a brake pedal having a fiber-reinforced composite arm with a first distal end adapted to be fixedly mounted to a structure of a vehicle and a second distal end having a foot pad mounted thereon;

at least one sensor molded within said brake pedal adapted to sense the amount of deflection of said brake pedal and send a corresponding signal;

a stop adapted to be mounted within the vehicle at a distance from said brake pedal such that said brake pedal will contact said stop after being flexed through said distance, said stop including a plurality of sections having different levels of stiffness, whereby said stop provides progressively increasing stiffness resistance to continued flexing of said brake pedal after said brake pedal contacts said stop.

* * * * *